US008720813B2

(12) United States Patent
Nordlund

(10) Patent No.: US 8,720,813 B2
(45) Date of Patent: May 13, 2014

(54) DISPENSER FOR DISPENSING PAPER FROM CENTER-FEED TISSUE PAPER ROLLS

(75) Inventor: Cecilia Nordlund, Söråker (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 13/516,491

(22) PCT Filed: Dec. 18, 2009

(86) PCT No.: PCT/EP2009/067586
§ 371 (c)(1),
(2), (4) Date: Jun. 15, 2012

(87) PCT Pub. No.: WO2011/072757
PCT Pub. Date: Jun. 23, 2011

(65) Prior Publication Data

US 2012/0256037 A1 Oct. 11, 2012

(51) Int. Cl.
*B65H 18/02* (2006.01)

(52) U.S. Cl.
USPC ..... 242/593; 242/615.3

(58) Field of Classification Search
USPC ..... 242/593, 132, 137, 146, 615.3, 615.4; 206/409, 390, 394; 220/253
See application file for complete search history.

(56) References Cited

U.S. PATENT DOCUMENTS

| | | | | |
|---|---|---|---|---|
| 5,219,126 | A | 6/1993 | Schutz | |
| 5,762,286 | A | 6/1998 | Schutz | |
| 5,762,287 | A | 6/1998 | Schutz | |
| 6,089,499 | A * | 7/2000 | Robinson | 242/593 |
| 6,189,730 | B1 | 2/2001 | McClymonds | |
| 6,199,791 | B1 | 3/2001 | Conran et al. | |
| 6,267,321 | B1 * | 7/2001 | Tramontina | 242/593 |
| 6,964,395 | B1 * | 11/2005 | Lewis et al. | 242/593 |
| 7,131,609 | B1 * | 11/2006 | Lewis et al. | 242/593 |
| 7,406,740 | B2 * | 8/2008 | Subramanian | 403/109.1 |
| 2006/0091146 | A1 | 5/2006 | Boulet-Mazer | |

FOREIGN PATENT DOCUMENTS

WO 93/22963 A1 11/1993

OTHER PUBLICATIONS

International Search Report (PCT/ISA/210) issued on Aug. 4, 2010, by the European Patent Office as the International Searching Authority for International Application No. PCT/EP2009/067586.
Written Opinion (PCT/ISA/237) issued on Aug. 4, 2010, by the European Patent Office as the International Searching Authority for International Application No. PCT/EP2009/067586.
International Preliminary Report on Patentability (PCT/IPEA/409) issued on Apr. 10, 2012, by the European Patent Office as the International Searching Authority for International Application No. PCT/EP2009/067586.

* cited by examiner

*Primary Examiner* — William A Rivera
(74) *Attorney, Agent, or Firm* — Buchanan Ingersoll & Rooney PC

(57) ABSTRACT

A dispenser for dispensing paper from center-feed tissue paper rolls, the dispenser having a housing with a receiving portion for receiving two center-feed rolls, one of which is a full paper roll and the other one an almost used-up paper roll squeezed into the form of a sickle to make the dispenser less bulky. The two rolls dispense through separate openings, which may be linked to a common dispensing nozzle spaced apart from the openings.

18 Claims, 2 Drawing Sheets

DISPENSER FOR DISPENSING PAPER FROM CENTER-FEED TISSUE PAPER ROLLS

TECHNICAL FIELD

The present invention pertains to a dispenser for dispensing paper from center-feed tissue paper rolls.

TECHNOLOGICAL BACKGROUND

Center-feed tissue paper rolls are typically dispensed from dispensers having a housing which is arranged to receive a single full center-feed tissue paper roll. Because only one center-feed tissue paper roll is received in the respective dispenser housings, it is fairly difficult for the service personnel to determine the right timing for replacing an almost empty center-feed tissue paper roll by a full one. The difficulty results from the fact that center-feed tissue paper rolls can only be replaced as a whole. This situation is substantially different from the situation in which paper from a tissue paper stack is dispensed because in this case, the tissue paper stack can be easily refilled by simply placing the needed quantity of single tissue paper towels on top of the almost used-up stack in the dispenser.

Because the exact timing for the replacement of an almost empty center-feed tissue paper roll is almost impossible to determine, the almost used-up center-feed tissue paper roll is typically thrown away, such that paper is wasted that could otherwise be used. In particular, the service personnel typically applies this approach because if it is waited too long with the replacement of an almost used-up tissue paper roll, a user could be faced with a dispenser which is empty. To be on the safe side, the service personnel rather throw the almost used-up stub roll away than risking a dissatisfaction of the user.

In order to overcome these disadvantages when using center-feed tissue paper rolls, WO 93/22963 A1 suggests placing two center-feed tissue paper rolls on top of one another and connecting the tail end of the lower roll with the leading end of the top roll, such that, if the first roll is used up, the second roll can be automatically dispensed as well. This gives the services personnel more flexibility in their timing.

U.S. Pat. No. 5,762,287 suggests placing two center-feed tissue paper rolls next to one another in a housing and making sure, by means of a mechanism, that the first tissue paper roll can be dispensed completely and only then an opening leading towards the dispensing portion of the second tissue paper roll can be accessed.

One disadvantage of the dispensers suggested in the prior art is that the respective housings become bulky and the mechanisms are quite complex and the replacement mechanisms are fairly fault-prone because they rely on a connection of the mechanism to a tissue paper sheet in order to activate the respective mechanism for changing from one roll to the other.

From U.S. Pat. No. 6,189,730 B1, a dispenser according to the preamble of claim 1 is known.

SUMMARY OF THE INVENTION

Accordingly, starting from the prior art dispensers, it is an object of the present invention to provide a dispenser for dispensing paper from a center-feed tissue paper roll which improves the serviceability and the reliability of the dispenser.

According to the solution of claim 1, the dispenser for dispensing paper from center-feed tissue paper rolls includes a housing with a receiving portion for receiving the paper to be dispensed and being in the form of a bottom wall of the housing, wherein a first dispensing opening and a second dispensing opening are provided in the receiving portion for dispensing paper from two center-feed rolls through the respective dispensing openings, the first dispensing opening and the second dispensing opening are arranged asymmetrically with respect to the outer limitations of the receiving portion such that the first dispensing opening is arranged to dispense paper from a full tissue paper center-feed roll and the second dispensing opening is arranged to dispense paper from an almost used-up tissue paper center-feed roll. The center of the first dispensing opening and the center of the second dispensing opening are spaced apart from one another by less than the diameter of a full tissue paper roll to be dispensed through the dispensing openings. The first dispensing opening and the second dispensing opening are connected to one another via a connection channel which extends in the receiving portion, in particular in the bottom wall of the housing.

This specific geometrical arrangement of the two dispensing openings in an asymmetrical fashion enables the provision of a dispenser in which the first opening is suitable to dispense tissue paper from a full center-feed tissue paper roll, and the second opening is suitable to dispense tissue paper from an almost empty center-feed tissue paper roll, without the need for mechanical connections between a mechanism and a tissue paper. Accordingly, the reliability of the dispenser according to the present application can be significantly improved as the dispensing process of the new roll does not rely on a connection of a mechanism to tissue paper.

Furthermore, because of the asymmetric arrangement of the dispensing openings, it becomes immediately apparent for the service personnel where to put an almost empty center-feed tissue paper roll and where to put the new full roll. In particular, in a situation in which the center-feed tissue paper roll, which is placed over the first dispensing opening, is almost empty or, for example, used-up down to approximately 30% of its original contents, this almost used-up center-feed tissue paper roll can be situated over the second dispensing opening which is intended to dispense the tissue paper from an almost used-up tissue paper roll, and a new, full tissue paper roll can be arranged over the first dispensing opening.

By means of the asymmetric shape, it is also possible to reduce the overall dimensions of the housing, because not two full center-feed tissue paper rolls need to be placed into the housing, but only one and an almost used-up tissue paper roll need to be housed in the dispenser.

In particular, it has been acknowledged by the inventor that it is not necessary to place two full center-feed tissue paper rolls into a housing in order to avoid wasting paper by throwing away an almost used-up tissue paper roll or to reduce the risk of completely running out of paper, but that it is only necessary to provide a space for an almost used-up tissue paper roll which can then be fully dispensed. At the same time, sufficient space needs to be provided for a new tissue paper roll which then can be further used as soon as the almost empty tissue paper roll is completely depleted.

In particular, it has been acknowledged that an almost depleted center-feed roll can be squeezed down such that its spatial requirements are substantially reduced with respect to a full center-feed roll. By squeezing down an almost depleted center-feed roll a substantial portion of its initial volume can be reduced without, however, sacrificing functionality. In particular, it is still possible to dispense paper from a squeezed-down center feed roll as long as the squeezing does not result in pinching the paper.

The term "center-feed" tissue paper roll refers to a tissue paper roll which is intended to be dispensed from the inside along the winding axis of the tissue paper roll. These rolls are also termed "center-flow" rolls or "coreless" rolls. The dispensing process of a center-feed tissue paper roll is typically such that the center-feed tissue paper roll is placed over a dispensing opening such that the tissue paper roll is substantially aligned upright, i.e. the winding axis of the tissue paper roll extends in an upright/vertical direction. The dispensing opening for center-feed tissue paper rolls is typically made such that the tissue paper can be easily withdrawn or dispensed from the center of the center-feed roll.

The dispensing openings are arranged in the asymmetrical manner as suggested above because the almost used-up center-feed roll needs substantially less space than the new, full center-feed roll. The dimensions of the housing can be substantially reduced by means of this specific arrangement such that a leaner dispenser results.

The distance between the center of the first dispensing opening and the center of the second dispensing opening is less than the diameter of a full tissue paper roll to be dispensed through the dispensing openings such that, in other words, two full center-feed tissue paper rolls cannot be placed next to one another with their centers aligned with the dispensing openings. For example, for full center-feed rolls having a diameter of 110 mmm the distance is less than 110 mmm but more than 55 mm.

This arrangement enables significantly reduced dimensions of the housing because, even though two center-feed tissue paper rolls can be placed in the housing, only one full and one almost used-up roll can be received in the housing.

Furthermore, in order to further improve the serviceability of the dispenser, the first dispensing opening and the second dispensing opening are connected to one another via a connection channel which extends in the receiving portion, in particular in the bottom wall of the housing. The connection channel has the advantage that the service personnel avoids threading the paper of the almost used-up center-feed tissue paper roll through a dispensing opening again but can easily move the paper of the almost used-up center-feed roll from the first dispensing opening to the second dispensing opening by simply sliding it through the channel.

Preferably, the receiving portion is dimensioned to receive the paper to be dispensed in the form of one full center-feed roll and one almost used-up center-feed roll. By means of this specific arrangement, the overall dimensions of the receiving portion of the housing and, thus, of the dispenser housing as such can be significantly reduced compared with a housing that is intended to receive two full center-feed tissue paper rolls.

In order to achieve a reduced housing yet maintaining the full functionality of the dispenser, the first dispensing opening has a minimum distance from the outer limitations of the receiving portion which is greater than the minimum distance of the second dispensing opening from the outer limitations of the receiving portion.

The term "minimum distance" is intended to refer to the shortest distance between the center of the dispensing opening to the nearest outer limitation of the receiving portion. The "outer limitation" of the receiving portion is given by its outer boundaries, e.g. by its circumference, by the portions which receive outer walls of the housing, or by the outer walls of the housing which define the volume of the housing.

Preferably, the first dispensing opening is distanced from the outer limitations of the receiving portion by at least a radius of a full tissue paper roll to be dispensed through this dispensing opening such that the full center-feed tissue paper roll can be easily received and placed over the dispensing opening. For example, for a full center-feed roll having a diameter of 110 mmm, the distance is at least 55 mm.

It is preferred if the second dispensing opening is distanced from the outer limitations of the receiving portion by significantly less than a radius of a full tissue paper roll to be dispensed through this dispensing opening in order to inherently instruct the service personnel where to put an almost used-up center-feed tissue paper roll and in order to be in a position to reduce the outer dimensions of the dispenser housing. For example, for a full center-feed roll having a diameter of 110 mmm the distance significantly less than 55 mm.

The receiving portion of the housing is preferably provided in the form of a bottom wall, the outer limitations thereof being substantially defined by the upright walls of the dispenser housing.

In order to achieve an easy to use dispenser for a user, the first dispensing opening and the second dispensing opening open out into a single dispensing nozzle, the dispensing nozzle being situated below the dispensing openings such that the user does not need to choose between two different dispensing nozzles but the dispenser dispenses the paper through the dispensing nozzle, irrespective whether the paper stems from the first full center-feed tissue paper roll situated above the first dispensing opening or from the second almost used-up center-feed tissue paper roll which is provided above the second dispensing opening. Preferably, the dispensing nozzle comprises a single dispensing opening for dispensing tissue paper and preferably includes tearing means, such as cutting teeth and/or a tear bar.

In order to improve the positioning of the almost used-up center-feed tissue paper roll, which is typically not structurally stable any more, at least one restriction element is provided to keep the almost empty tissue paper center-feed roll in a defined position with respect to the second dispensing opening. In order to improve the dispensing characteristics but to enable a proper positioning of the full center-feed tissue paper roll, the restriction element is preferably arranged symmetrically with respect to the second dispensing opening and asymmetrically with respect to the outer limitations of the receiving portion. As a design choice, the at least one restriction element is mounted at a bottom wall, at an upright sidewall or at a right-hand side wall of the housing and the at least one restriction element is preferably made from a rigid material or a flexible material, preferably from a rubber material or silicon.

In order to improve the exchange process of the center-feed paper rolls, the first dispensing opening may be connected to the outside of the housing by means of an insertion channel which extends in the receiving portion, in particular in the bottom wall of the housing, to the outer limitations of the bottom wall such that it can be accessed from the outside of the housing, preferably if a housing cover is removed. The service personnel can, thus, easily move the leading paper end through the insertion channel into the first dispensing opening without the need to thread the paper through the dispensing opening.

BRIEF DESCRIPTION OF THE FIGURES

In the following, embodiments of the present invention will be described by way of the attached Figures, in which.

DESCRIPTION OF PREFERRED EMBODIMENTS

Figure 2:
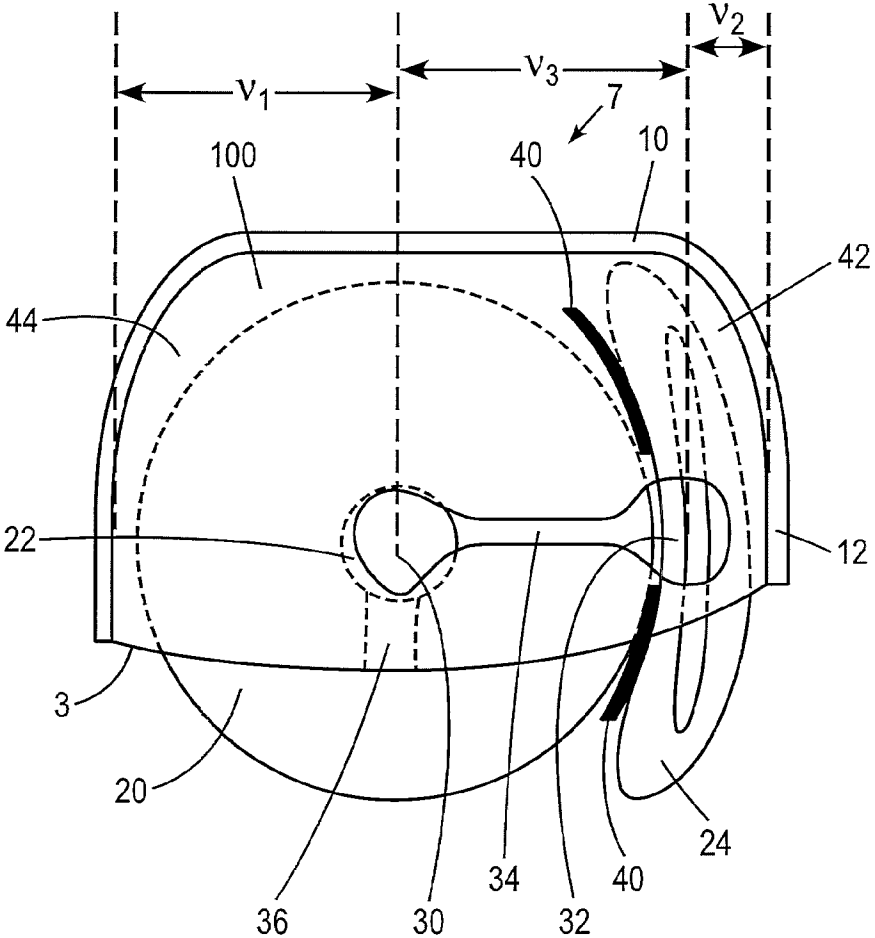
FIG. 2 is a top view of the dispenser according to FIG. 1.

In the following, dispensers according to the present disclosure will be described by way of example. In the Figures, the same reference numerals will be used for the same or like elements and repeated description thereof may be omitted in order to reduce redundancies.

Figure 1:
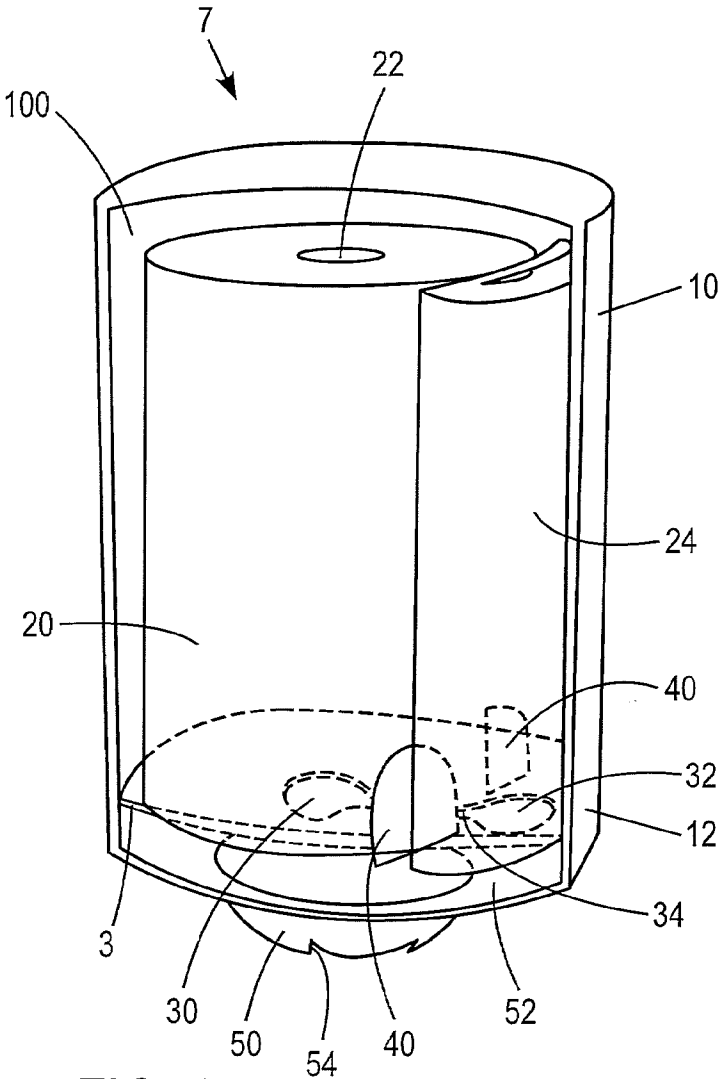
FIG. 1 is a perspective side view of a dispenser which houses a full center-feed tissue paper roll and an almost used-up center-feed tissue paper roll.

FIGS. 1 to 4 show a dispenser 1 for dispensing paper from center-feed tissue paper rolls. The dispenser includes a housing 10 which defines a volume 100 for receiving the center-feed tissue paper rolls from which the paper is intended to be dispensed. In FIG. 1, only a portion of the housing 10 is shown, with the front wall removed for clarity reasons. The front wall will be closed, however, in the typical embodiments as it is customary for dispensers.

A full center-feed tissue paper roll 20 is schematically shown in the housing 10. The center-feed tissue paper roll 20 includes, in its center, a coreless core 22, from which the tissue paper is actually dispensed. An almost empty tissue paper roll 24 is likewise shown in the housing 10, the almost empty tissue paper roll 24 having only left a paper content of approximately 20% to 30% of the full tissue paper roll. The almost empty tissue paper roll 24 has been squeezed down/squashed down to have a sickle/banana shape, such that it substantially fits around the contours of the full tissue paper roll 20.

The full tissue paper roll 20 and the almost empty tissue paper roll 24 are placed into the housing 10 of the dispenser 1, such that the full tissue paper roll 20 is placed with its core 22 over a first dispensing opening 30, which is situated in a receiving portion 3 for receiving the center-feed tissue paper rolls 20, 22. The receiving portion is provided in the form of the bottom wall 3 which defines the volume 100 of the housing 10.

A second dispensing opening 32 is present, which is situated closely towards the outer limitations of the bottom wall 3 of the housing 10 such that it is, in the embodiment shown in FIG. 1, situated almost immediately at the right-hand side wall 12 of the housing 10.

The actual arrangement of the two dispensing openings 30 and 32 is shown, in a top view of the dispenser 1 of FIG. 1, in FIG. 2. It becomes immediately apparent that the first dispensing opening 30, which is intended to dispense paper from the full tissue paper roll 20, is situated in the bottom wall 3 such that the full tissue paper roll 20 can be placed with its coreless core 22 in full alignment with the first dispensing opening 30. In other words, the center 22 of the full tissue paper roll 20 can be placed exactly over this dispensing opening 30 such that paper can be easily dispensed. The bottom wall 3 of the dispenser 1 is provided such that its outer boundaries extend sufficiently to support the bottom footprint of the full tissue paper roll 20.

The second dispensing opening 32 is situated almost at the outer boundary of the bottom wall 3 towards the right-hand side wall 12 of the dispenser 1. The reason for this arrangement of the second dispensing opening 32 almost at the outer boundary of the bottom wall 3 is that the almost empty tissue paper roll 24 will be squeezed down substantially into the shape shown in FIGS. 1 and 2, i.e. a sickle shape, and the paper which is dispensed from the almost empty tissue paper roll 24 through the dispensing opening 32 is, thus, fed very much at the right-hand side wall 12 of the dispenser 1.

When considering the footprint of the bottom wall 3 with respect to the arrangement of the first dispensing opening 30 and the second dispensing opening 32, it becomes apparent that the two dispensing openings are situated asymmetrically with respect to the outer boundaries of the receiving portion 3.

The term "asymmetric" is intended to mean that the dispensing opening 30, which is intended to dispense paper from the full tissue paper roll 20, is situated much more spaced apart from the outer boundaries of the bottom wall 3 than the second dispensing opening 32, which is, indeed, placed substantially almost at the edge/outer boundary of the bottom wall 3.

In the present embodiment, the second dispensing opening 32 is provided almost at the right-hand side wall 12 of the housing 10.

The term "outer boundary" is intended to refer to the outer extension of the bottom wall 3, in particular with respect to its functionality. It is intended to mean the boundary between the actual usable area of the bottom wall 3 and its unusable area for placing tissue paper rolls. This outer boundary is typically defined by the side walls of the dispenser.

In order to improve the serviceability of the dispenser 1, restriction elements 40 are placed such that a section 42 of the receiving portion 3 is divided from another section 44 of the receiving portion 3. The restriction elements 40 are intended to maintain the almost empty tissue paper roll 24 in its squashed down position, substantially pressed towards the right-hand side wall 12 of the dispenser 1 when a service person inserts a new full center-feed tissue paper roll 20 into the dispenser 1.

The restriction elements 40 are also intended to guide the full tissue paper roll 20 into its optimum position such that the dispensing opening 30 is aligned with the coreless core 22 of the full tissue paper roll 20. The restriction elements 40 are, furthermore, intended to avoid that the full tissue paper roll 20 is pushed into the dispenser too far and presses onto the almost empty tissue paper roll 24 to jam it, such that tissue paper cannot be dispensed anymore from the almost empty tissue paper roll 24.

The restriction elements 40 are preferably provided in the form of a single, or two small sidewalls/winglets which substantially resemble the outer contours of the full tissue paper roll 20. The restriction elements 40 are placed such that the almost empty tissue paper roll 24 can be placed and maintained on one of their sides, and the full tissue paper roll 20 can be placed on the other of their sides.

Because the arrangement of the dispensing openings 30 and 32 is asymmetric with respect to the outer boundaries of the bottom wall 3, this is also the case for the restriction elements 40.

It will be appreciated that the functionality of the dispenser is also given without the provision of the restriction elements 40. In particular, it is also possible to maintain the almost finished tissue paper roll 24 in its squashed-down arrangement by using the full tissue paper roll 20 for restricting the almost empty roll in its position.

Naturally, other shapes for the dispenser, and in particular its housing 10, as that given in FIG. 1 are contemplated. In this respect it is also to be noted that the arrangement of the first dispensing opening 30 and the second dispensing opening 32 can be reversed such that the second dispensing opening is situated towards the left-hand side wall, towards the back wall or towards the front wall of the housing or could even be situated in diagonal line or any other arrangement that enables the asymmetric arrangement of the first dispensing opening and the second dispensing opening.

Nevertheless, the footprint of the receiving portion 3 shown in FIGS. 1 and 2 provides for a dispenser which has reduced outer dimensions over a dispenser in which two full tissue paper rolls are to be included, and provides a fairly compact dispenser 1, still having an increased efficiency and serviceability with respect to the exchange of almost depleted rolls.

The process of refilling the dispenser 1 is fairly simple. If a service person determines that the center-feed tissue paper roll 20 which is situated above the first dispensing opening 30 has been dispensed down to 20% to 30% of its original volume, then this almost empty tissue paper roll is squashed down into the sickle/banana shape and pushed towards the right-hand side wall 12 of the dispenser 1, such that tissue paper can be dispensed through the second dispensing opening 32. In a case in which the restriction elements 40 are present, this almost empty tissue paper roll 24, which could also be referred to as a "stub tissue paper roll", could be positioned behind the restriction elements such that the area on the bottom wall 3, which is intended to receive the next full tissue paper roll 20, is kept free.

Then the service person places a new, full center-feed tissue paper roll 20 into this space and aligns it with the first dispensing opening 30. A user can then first dispense tissue paper from the almost empty tissue paper roll 24 through the dispensing opening 32 and, if this roll is completely empty, the user will turn to the full tissue paper roll 20 and dispense tissue paper through the dispensing opening 30.

In order to enable the user to understand and easily use the dispenser 1, FIG. 1 shows a dispensing nozzle 50 which is situated below the bottom wall 3 of the dispenser 1 and which embraces the first dispensing opening 30 and the second dispensing opening 32. In the embodiment shown, there is a compartment 52 present between the actual dispensing nozzle 50 and the bottom wall 3 of the housing wherein the compartment 52 embraces the two dispensing openings 30, 32.

In other words, even though the dispenser 1 has two different dispensing openings 30 and 32, the actual dispensing nozzle 50 shows only a single dispensing opening through which tissue paper from either the first dispensing opening 30 or the second dispensing opening 32 can be dispensed. A tearing means in the form of teeth 54 are provided around the dispensing opening of the dispensing nozzle 50, such that tissue paper which has been withdrawn through dispensing opening can be easily torn, such that it can be used.

In order to ease the understanding of the user with respect to the dispensing of the two different tissue paper rolls, the service personnel would try to "hide" the leading end of the new tissue paper roll 20 somewhere within the dispensing nozzle 50 or compartment 52, but would pull the leading end of the almost empty tissue paper roll 24 through the dispensing opening of the dispensing nozzle 50, such that the user would intuitively grip the right leading end and only if the almost empty tissue paper roll 24 is fully used up, a user would start feeling around inside the dispensing nozzle 50 or the compartment 52 for the leading end of the then to be used full tissue paper roll 20.

In the embodiment shown, it becomes apparent that the first dispensing opening 30 and the second dispensing opening 32 are actually connected with one another by means of a connection channel 34. The reason for the presence of this connection channel 34 between the first dispensing opening 30 and the second dispensing opening 32 is that the connection channel 34 provides a much easier handling of the refilling process for the service personnel. In particular, when the then almost empty tissue paper roll 24 is to be moved from its position aligned with the first dispensing opening 30 into its position aligned with the second dispensing opening 32, the service person only needs to push the almost empty tissue paper roll 24 into its position at the right-hand side wall 12 of the dispenser 1, but does not have to thread the leading end of the almost empty tissue paper roll 24 through the second dispensing opening 32 again. This substantially improves the handling, in particular also because the almost empty tissue paper roll 24 is not very stable anymore.

It is also contemplated in an alternative embodiment to provide an insertion channel 36 towards the outside of the receiving portion 3 (shown as a dotted line in FIG. 2). This insertion channel 36, for example in the form as shown by means of the dotted insertion channel 36 in FIG. 2, is provided such that not only the leading end of the almost empty tissue paper roll 24 can be easily pushed from the first dispensing opening 30 towards the second dispensing opening 32, but that also the leading end of the new tissue paper roll 20, which is to be aligned with the first dispensing opening 30, can be pushed in from the side, such that tedious threading can be avoided for the service personnel.

The arrangement of the dispensing openings in connection with the connection channel 34 can be bone-shaped, egg-shaped or pear shaped. The dispensing openings as such may have a round, triangular, oval, circular, rectangular, square or any other suitable form which serves as a suitable flow restriction for the tissue paper.

The dispensing nozzle 50 may have a dispensing opening of a circular, triangular, rectangular or pear shape which preferably includes a tearing means, preferably teeth, a serrated section, a section of reduced width, a knife or an elastic nozzle.

As to the actual dimensions of the first dispensing opening 30 and the second dispensing opening 32 with respect to the outer boundaries of the receiving portion/bottom wall 3, the distance $r_1$ of the center of the first dispensing opening 30 to the outer boundary of the bottom wall 3 corresponds substantially to the radius of a full tissue paper roll 20 which is to be dispensed through the dispensing opening 30. The diameters of center-feed tissue paper rolls which are typically used are in a range of 110 mm to 273 mm. Accordingly, for example for a dispenser which is intended for 110 mm rolls, $r_1$ would be at least 55 mm.

Figure 3:
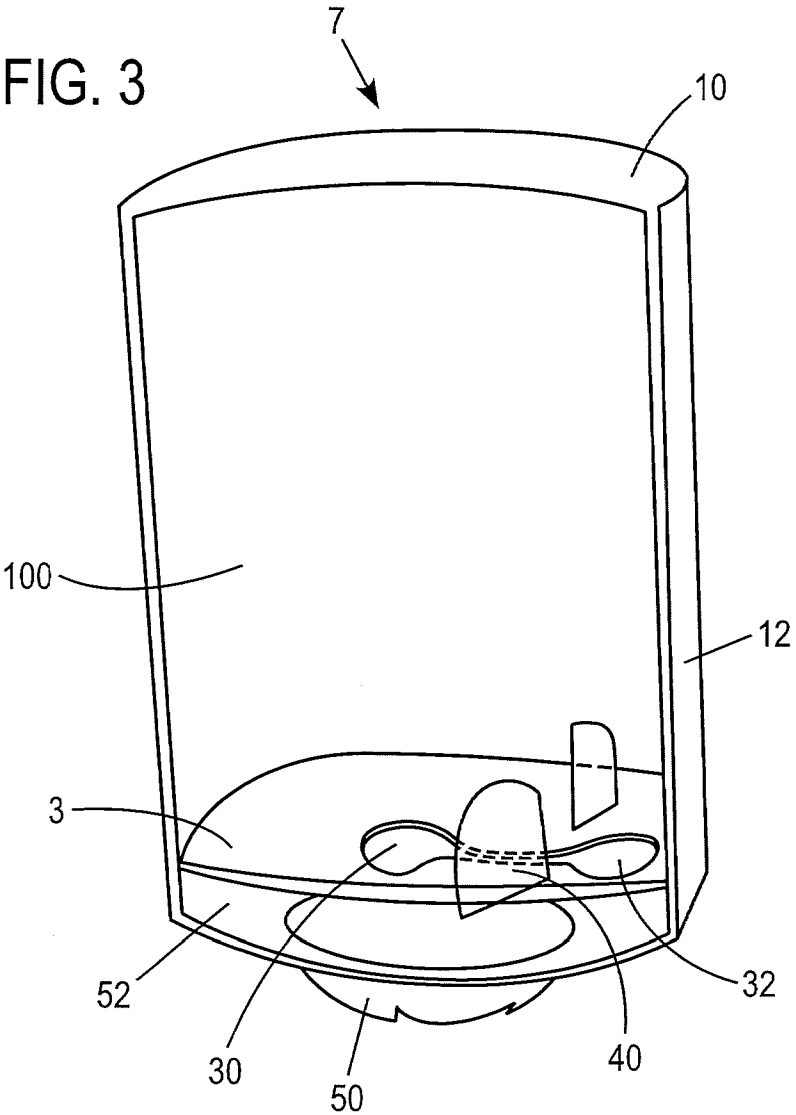
FIG. 3 is a schematic perspective side view of the dispenser of FIGS. 1 and 2 without the tissue paper rolls inserted.

The distance $r_2$ between the center of the second dispensing opening 32 and the outer boundary of the bottom wall 3, which is in the case shown in FIG. 3 the position where the right-hand side wall 12 connects to the bottom wall 3, is substantially smaller than the distance $r_1$. In particular, $r_2$ is substantially smaller than the radius of a full tissue paper roll 20 which is to be dispensed through the first dispensing opening 30. In an extreme case, the distance $r_2$ is almost 0. For example, for a dispenser intended for 110 mm rolls, $r_2$ would be significantly smaller than 55 mm.

In order to provide a relatively compact housing 10 of the dispenser 1, the distance $r_3$ between the center of the first dispensing opening 30 and the center of the second dispensing opening 32 is substantially smaller than two radii (i.e. the diameter) of a full tissue paper roll 20 which is to be dispensed through the first dispensing opening 30. In other words, by means of the asymmetrical arrangement of the first dispensing opening 30 and the second dispensing opening 32 with respect to the outer boundaries of the bottom wall 3 of the dispenser 1, it can be achieved that the overall dimensions of the dispenser 1, in particular with respect to its footprint, can be considerably reduced. This is mainly the case because the distances are measured in the direction which is defined by the centers of the two dispensing openings 30, 32. For example, for a dispenser for 110 mm rolls, $r_3$ would be smaller than 110 mm but not smaller than 55 mm.

The restriction element 40 can be, of course, made from the same material as that of the dispenser 1 or at least from the same material as that of the bottom wall 3. In particular, it can be made from a hard plastics material, such as polyethylene. However, it is also contemplated to provide the restriction elements 40 in the form of flexible wings made, for example, from rubber or silicone. The restriction elements 40 do not need to be mounted to the bottom wall 3, but can also be mounted to the sidewalls of the dispenser or to the right-hand side wall of the dispenser.

Figure 4:
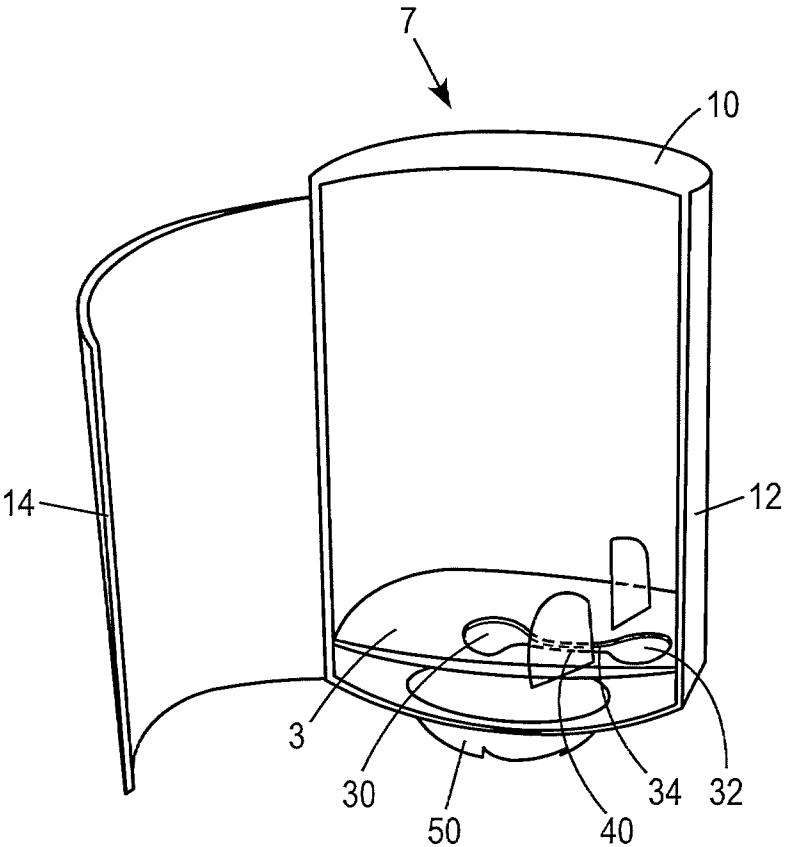
FIG. 4 is yet another schematic perspective side view of the dispenser shown in FIGS. 1 to 3, with a covering door attached.

FIG. 4 shows the dispenser with a front door 14 attached which can be used to close the dispenser housing if the service personnel has finished the replacement process.

The invention claimed is:

1. Dispenser for dispensing paper from center-feed tissue paper rolls, the dispenser having a housing, the housing comprising a dispensing nozzle and volume, the volume comprising a receiving portion for receiving the paper to be dispensed and being in the form of a bottom wall of the volume, wherein the dispensing nozzle is situated below the volume, wherein a first dispensing opening and a second dispensing opening are provided in the receiving portion for dispensing paper from two center-feed rolls through the respective dispensing openings, the first dispensing opening and the second dispensing opening are arranged asymmetrically with respect to the outer limitations of the receiving portion such that the first dispensing opening is arranged to dispense paper from a full tissue paper center-feed roll and the second dispensing opening is arranged to dispense paper from an almost used-up tissue paper center-feed roll, the center of the first dispensing opening and the center of the second dispensing opening are spaced apart from one another by less than the diameter of a full tissue paper roll to be dispensed through the dispensing openings, and the first dispensing opening and the second dispensing opening are connected to one another via a connection channel which extends in the receiving portion, in the bottom wall of the volume.

2. Dispenser according to claim 1, wherein the receiving portion is dimensioned to receive the paper to be dispensed in the form of one full center-feed roll and one almost used-up center-feed roll.

3. Dispenser according to claim 1, wherein the first dispensing opening has a minimum distance from the outer limitations of the receiving portion which is greater than the minimum distance of the second dispensing opening from the outer limitations of the receiving portion.

4. Dispenser according to claim 1, wherein the first dispensing opening is distanced from the outer limitations of the receiving portion by at least a radius of a full tissue paper roll to be dispensed through this dispensing opening.

5. Dispenser according to claim 1, wherein the second dispensing opening is distanced from the outer limitations of the receiving portion by significantly less than a radius of a full tissue paper roll to be dispensed through this dispensing opening.

6. Dispenser according to claim 1, wherein the outer limitations of the bottom wall being substantially defined by the upright walls of the dispenser housing.

7. Dispenser according to claim 1, wherein the first dispensing opening and the second dispensing opening open out into a single dispensing nozzle.

8. Dispenser according to claim 7, wherein the dispensing nozzle comprises a single dispensing opening for dispensing tissue paper.

9. Dispenser according to claim 7, wherein the dispensing nozzle includes tearing device.

10. Dispenser according to claim 9, wherein the tearing device is teeth, a serrated section, a section of reduced width, a knife or an elastic nozzle.

11. Dispenser according to claim 1, wherein at least one restriction element is provided to keep an almost empty tissue paper center-feed roll in a defined position with respect to the second dispensing opening.

12. Dispenser according to claim 11, wherein the restriction element is arranged symmetrically with respect to the second dispensing opening and asymmetrically with respect to the outer limitations of the receiving portion.

13. Dispenser according to claim 11, wherein the at least one restriction element is mounted at a bottom wall and/or an upright sidewall and/or a right-hand side wall of the volume.

14. Dispenser according to claim 11, wherein the at least one restriction element is made from a rigid material or a flexible material.

15. Dispenser according to claim 11, wherein the at least one restriction element is made from a rubber material or silicon.

16. Dispenser according to claim 1, wherein the first dispensing opening is connected to the outside of the volume by means of an insertion channel which extends in the receiving portion to the outer limitations of the bottom wall such that the first dispensing opening can be accessed from the outside of the volume.

17. Dispenser according to claim 1, wherein the first dispensing opening can be accessed from the outside of the volume if a housing cover is removed.

18. Dispenser according to claim 1, wherein the connection channel joins together the first and second dispensing openings, such that the connection channel, first dispensing opening, and second dispensing opening form a common opening in the bottom wall of the volume.

* * * * *